US007011544B1

(12) United States Patent
Zemba

(10) Patent No.: US 7,011,544 B1
(45) Date of Patent: Mar. 14, 2006

(54) MULTIPHASE CONNECTOR

(75) Inventor: Hirotaka Zemba, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/205,131

(22) Filed: Aug. 17, 2005

(30) Foreign Application Priority Data

Aug. 30, 2004 (JP) ..... 2004-251007

(51) Int. Cl.
*H01R 9/05* (2006.01)

(52) U.S. Cl. ..... 439/578

(58) Field of Classification Search ..... 439/578, 439/581, 63, 584, 620, 579, 541.5, 322, 352
See application file for complete search history.

(56) References Cited

U.S. PATENT DOCUMENTS 6,692,285 B1 * 2/2004 Islam ..... 439/352
6,790,083 B1 * 9/2004 Chen ..... 439/583
6,808,407 B1 * 10/2004 Cannon ..... 439/314
6,824,392 B1 * 11/2004 Guo ..... 439/63
6,866,543 B1 * 3/2005 Chen et al. ..... 439/578
6,875,024 B1 * 4/2005 Nagano ..... 439/63
2005/0085125 A1 * 4/2005 Montena ..... 439/578
2005/0136735 A1 * 6/2005 Rodrigues et al. ..... 439/578
2005/0176293 A1 * 8/2005 Khemakhem et al. ..... 439/578

FOREIGN PATENT DOCUMENTS

JP 11-339890 12/1999
JP 2001-267006 9/2001

* cited by examiner

*Primary Examiner*—J. F. Duverne
(74) *Attorney, Agent, or Firm*—Takeuchi&Kubotera,LLP

(57) ABSTRACT

When the sleeve (3) is rotated, the locking portion (3B) disposed on the sleeve (3) slides against one or the other of the inclined cam surfaces (47A-1 and 47A-2), and is inserted into the engaging groove portion (47B) of the locking groove portion (47). The locking portion (3B) reaches the locking seat portion (47*b*) through moving over the cam portion (47*a*) disposed on the engaging groove portion (47B). The spring washer (29) urges the locking portion (3B) to be seated on the locking seat portion (47*b*).

8 Claims, 8 Drawing Sheets

MULTIPHASE CONNECTOR

BACKGROUND OF THE INVENTION

1. Field of the Invention

The present invention relates to a multiphase connector having a plug connector and a receptacle connector with improved lock means for locking the plug connector to the receptacle connector.

2. Description of the Related Art

Patent Reference 1 has disclosed a conventional multiphase connector. As shown in FIG. 8 to FIG. 12, the conventional multiphase connector has a connector C1 and a mating connector C2. The connector C1 is formed of a connector main body 100, a sleeve 110, and a spring member 120. The connector main body 100 has a connector engaging portion 101 at a distal end thereof. The connector engaging portion 101 is provided with a spring receptacle seat 102 with a circular shape; a projecting portion 103 extending along a direction that the connector is inserted and pulled out; and a step portion 105 on an outer circumference thereof. The connector engaging portion 101 is also provided with a projecting portion 104 at one position in a circumference direction.

The sleeve 110 is provided with a recess portion 112 at one position in a circumference direction of an edge portion 111 thereof. The recess portion 112 has a lateral width larger than a lateral width of the projecting portion 104. The sleeve 110 is also provided on an inner circumferential side of a front end portion thereof with a guide groove 115 extending between a front end surface of the sleeve 110 and a starting portion of a guide surface 114 of a long hole 113. The sleeve 110 engages the engaging portion 101 to be rotatable. The spring member 120 is disposed between the edge portion 111 of the sleeve 110 and the spring receptacle seat 102. A positioning mechanism is formed of the projecting portion 104 and the recess portion 112.

When the sleeve 110 moves backward and the projecting portion 104 engages the recess portion 112, a gap is formed as a play space between the projecting portion 104 and the recess portion 112, so that the sleeve 110 is allowed to rotate within a specific angle in the play space. When the projecting portion 104 engages the recess portion 112, as shown in FIG. 9, the sleeve 110 abuts against the step portion 105, so that a retraction position of the sleeve 110 is restricted and the position becomes an initial position of the sleeve 110.

As shown in FIG. 9, the mating connector C2 has an engagement portion 121 with a cylindrical shape. The engagement portion 121 is provided with outward projecting portions 123 at two positions in a circumferential direction separated by 180 degrees. The engagement portion 121 is also provided with a long groove portion (not shown) extending in the direction that the connector is inserted and pulled out.

An engaging mechanism is formed of the projecting portion 103 of the connector C1 and the groove portion of the mating connector C2. The engaging mechanism restricts an engaging position of the engaging portion 101 of the connector C1 and the engagement portion 121 of the mating connector C2 in the circumferential direction. After the projecting portion 103 of the connector C1 is positioned in the groove portion of the mating connector C2, when the engaging portion 101 is inserted and engages the engagement portion 121 of the mating connector C2, the outward projecting portions 123 of the mating connector C2 are inserted into the long holes 113 of the sleeve 110 through the guide grooves 115 to be guided into the starting portions of the guide surfaces 114 as shown in FIG. 9. At this time, even if the sleeve 110 idly rotates at the initial position, the outward projecting portions 123 of the mating connector C2 are guided into the starting portions of the guide surfaces 114 with the guide grooves 115.

A locking operation is performed through rotating the sleeve 110. That is, after the both connectors C1 and C2 are connected, when the sleeve 110 is rotated in an arrow direction R, the outward projecting portions 123 push the guide surfaces 114 in a forward direction, so that the sleeve 110 moves forward while rotating against an urging force of the spring member 120. Accordingly, after the engaging position of the guide surfaces 114 and the outward projecting portions 123 moves through a state shown in FIG. 10, the long holes 113 engage the outward projecting portions 123, thereby achieving a locked state as shown in FIG. 11 and FIG. 12.

When the locking operation is performed as described above, if the sleeve 110 is situated at the initial position, the recess portion 112 is situated at the projecting portion 104 of the positioning mechanism. Accordingly, it is impossible to rotate the sleeve 110 beyond a range of the idle rotation described above while the sleeve 110 is situated at the initial position.

When the both connector C1 and C2 are connected, the outward projecting portions 123 of the mating connector C2 are guided into the starting portions of the guide surfaces 114. Accordingly, when the sleeve 110 is rotated, the outward projecting portions 123 slide along the guide surfaces 114 to move the sleeve 110 forward. When the sleeve 110 is moved forward, the projecting portion 114 moves out from the recess portion 112 of the positioning mechanism, so that the sleeve 110 is released from the restricted state (positioned state) with respect to a rotational angle thereof. As a result, after the both connectors C1 and C2 are connected, it is possible to lock just through rotating the sleeve 110.

Patent Reference 2 has disclosed a conventional multiphase connector. As shown in FIG. 13 and FIG. 14, a coupling nut 201 is rotatably attached to a plug 200. A pair of engaging pins 202 is disposed on an inner circumferential surface of the coupling nut 201. In this case, it is arranged such that the coupling nut 201 does not move relative to a barrel 203 in a direction that the connector is inserted and pulled out. A pair of cam grooves 212 with a substantially L shape is disposed on an outer circumferential surface of a shell 211 of a receptacle 210.

When a plug 200 linearly engages the receptacle 210 in an arrow direction as shown in FIG. 14, each engaging pin 202 abuts against and is guided with an introducing portion of each cam groove 212, so that the coupling nut 201 rotates by a certain angle. Then, the coupling nut 201 rotates in an opposite direction with a restoration force of a torsion coil spring (not shown) disposed in the plug 200 with both ends fixed, so that each engaging pin 202 enters a lock portion 212A of each cam groove 212. Accordingly, the plug 200 is connected to the receptacle 210, and is locked with the torsion coil spring.

Patent Reference 1: Japanese Patent Publication No. 11-339890

Patent Reference 2: Japanese Patent Publication No. 2001-267006

In the conventional multiphase connector disclosed in Patent Reference 1, when the locking operation is performed as described above, if the sleeve 110 is situated at the initial position, the recess portion 112 engages the projecting portion 104 of the positioning mechanism. That is, the sleeve 110 is restricted with respect to the rotational angle thereof (positioning). When the sleeve 110 is moved forward, the projecting portion 114 moves out from the recess portion 112, so that the sleeve 110 is released from the rotationally restricted state and rotates for locking.

As described above, the sleeve 110 is restricted with respect to the rotational angle thereof (positioning) at the initial position. When the sleeve 110 is moved forward, the sleeve 110 is released from the rotationally restricted state. That is, it is necessary to move the sleeve 110 forward, thereby increasing a total length of the engaging portion 101. Accordingly, it is difficult to reduce a whole size of the connector.

In the conventional multiphase connector disclosed in Patent Reference 2, when the plug 200 engages the receptacle 210, each engaging pin 202 abuts against and is guided with the introducing portion of each cam groove 212, so that the coupling nut 201 rotates by a certain angle. Then, the coupling nut 201 rotates in an opposite direction with a restoration force of the torsion coil spring (not shown) with both ends fixed, so that each engaging pin 202 enters the lock portion 212A of each cam groove 212, thereby locking with the torsion coil spring. That is, each engaging pin 202 enters the lock portion 212A of each cam groove 212 for locking with an urging force of the torsion coil spring. Accordingly, it is necessary to fix the torsion coil spring, and it is difficult to securely lock the connector. Further, when the coupling nut is rotated against an urging force of the torsion coil spring, the coupling nut may be damaged.

SUMMARY OF THE INVENTION

In view of the problems described above, an object of the present invention is to provide a multiphase connector in which it is possible to reduce a whole size of the connector and it is easy to assemble.

According to the present invention, a multiphase connector includes a connector engaging portion of a connector for engaging a mating connector engaging portion of a mating connector, so that a contact terminal of the multiphase connector contacts with a contact terminal of the mating connector; and lock means for connecting the connector to the mating connector. The connector engaging portion includes a connector main body and a sleeve attached to the connector main body to be rotatable within a specific angle. The lock means includes a locking portion disposed on the sleeve and a locking groove portion disposed on the mating connector engaging portion. The locking groove portion includes a guide groove portion for guiding the locking portion when the sleeve is rotated, and an engaging groove portion for detachably engaging the locking portion when the sleeve is further rotated. An entrance portion of the guide groove portion has a width larger than that of the engaging groove portion. Sleeve rotation restricting means is provided for restricting a rotational amount of the sleeve upon engaging between the guide groove portion and the engaging groove portion.

With the configuration described above, when the connector is pushed into the mating connector, the locking portion disposed on the sleeve is inserted into the guide groove portion of the locking groove portion. In this state, when the sleeve is rotated, the locking portion is inserted into the engaging groove portion, thereby completing locking. When the sleeve is rotated in an opposite direction, the locking portion moves to the guide groove portion through the engaging groove portion, thereby releasing the locking.

Accordingly, in the present invention, it is not necessary to restrict a rotational angle of the sleeve (positioning) at an initial position. Therefore, it is not necessary to move the sleeve forward for releasing the rotational restriction of the sleeve, thereby making it possible to reduce a whole size of the connector. Further, it is not necessary to arrange a torsion coil spring for inserting each engaging pin into a lock portion of each cam groove to lock, thereby eliminating a step of fixing the torsion coil spring and making it easy to assemble.

According to the present invention, in the multiphase connector described above, the sleeve may be movable within a specific distance in a direction that the connector is inserted and pulled out. The locking means may include locking fixing means. The engaging groove portion may include a cam portion and a locking seat portion. The locking fixing means includes a spring member to be compressed when the locking portion slides against the cam portion upon rotating the sleeve. The spring member urges the locking portion to be seated on the locking seat portion.

With the configuration described above, when the connector is inserted into the mating connector, the locking portion disposed on the sleeve is inserted into the guide groove portion of the locking groove portion to rotate the sleeve. When the locking portion slides against the cam portion and reaches the locking seat portion, the spring member of the locking fixing means urges the locking portion through the sleeve to be seated on the locking seat portion, thereby completing the locking. When the sleeve is rotated in an opposite direction, the locking portion moves to the guide groove portion through the locking seat portion and the cam portion, thereby releasing the locking.

Accordingly, in the present invention, it is not necessary to restrict a rotational angle of the sleeve (positioning) at an initial position. Therefore, it is not necessary to move the sleeve forward for releasing the rotational restriction of the sleeve, thereby making it possible to reduce a whole size of the connector. Further, it is not necessary to arrange a torsion coil spring for inserting each engaging pin into a lock portion of each cam groove to lock, thereby eliminating a step of fixing the torsion coil spring and making it easy to assemble.

According to the present invention, in the multiphase connector described above, the connector may include a connector shell. The connector shell is provided with a partition portion on an outer circumferential surface thereof. The sleeve may include a supporting portion at an end portion thereof. The sleeve is attached to the outer circumferential surface of the connector shell with the supporting portion to be rotatable and movable in a direction that the connector is inserted and pulled out, so that the partition portion slides on an inner circumferential surface of the sleeve. A stopper is provided on the outer circumferential surface of the connector shell. The spring member is disposed between the supporting portion and the partition portion for urging the supporting portion to slide against the stopper, thereby forming the locking fixing means.

With the configuration described above, in the locking fixing portion, the spring member is compressed when the locking portion moves on the cam portion. When the locking portion is seated on the locking seat portion, the spring member presses the locking portion against the locking seat portion, thereby securely seating the locking portion on the locking seat portion. Accordingly, the cam portion interferes with the locking portion not to move the locking portion, thereby securing the locking. Further, the sleeve does not come off the connector shell with the stopper. Accordingly, when the connector is disassembled, the sleeve does not come off, thereby making it easy to disassemble and assemble.

According to the present invention, in the multiphase connector described above, the sleeve rotation restricting means may include a sleeve rotation groove portion in the partition portion over a specific angle. A projecting portion may be disposed on the supporting portion. The projecting portion is inserted into the sleeve rotation groove portion to regulate a rotational range of the sleeve.

With the configuration described above, it is possible to set the rotational range of the sleeve according to a position of the locking groove portion.

According to the present invention, in the multiphase connector described above, the guide groove portion may have a funnel shape with a width gradually decreasing from a distal end of the mating connector engaging portion in the direction that the connector is inserted and pulled out. Inclined cam surfaces inclined in opposite directions may be formed on both side portions of the guide groove portion. The engaging groove portion may be inclined in a direction perpendicular to the direction that the connector is inserted and pulled out. One of side surface portions of the engaging groove portion is connected to one of the inclined cam surfaces, and the other of the side surface portions is connected to the other of the inclined cam surfaces. A bulge portion is disposed on the one of the side surface portions as the cam portion. The cam portion positions the locking seat portion at an end portion of the engaging groove portion.

With the configuration described above, when the connector is pushed into the mating connector, the locking portion disposed on the sleeve is inserted into the guide groove portion of the locking groove portion, so that the locking portion slides against one or the other of the inclined cam surfaces to rotate the sleeve. In this state, when the sleeve is rotated, the locking portion is inserted into the engaging groove portion, and reaches the locking seat portion through moving over the cam portion. The spring member urges the locking portion to be securely seated on the locking seat portion. In this state, the cam portion interferes with the locking portion not to move the locking portion, thereby securing the locking.

According to the multiphase connector of the present invention, it is possible to reduce a whole size of the connector. It is easy to assemble the connector. The sleeve does not come off the connector shell with the stopper. Accordingly, when the connector is disassembled, the sleeve does not come off, thereby making it easy to disassemble and assemble.

Further, according to the multiphase connector of the present invention, it is possible to set the rotational range of the sleeve according to a position of the locking groove portion.

DESCRIPTION OF THE PREFERRED EMBODIMENTS

Hereunder, embodiments of the present invention will be explained with reference to FIG. 1 to FIG. 7.

Figure 1:
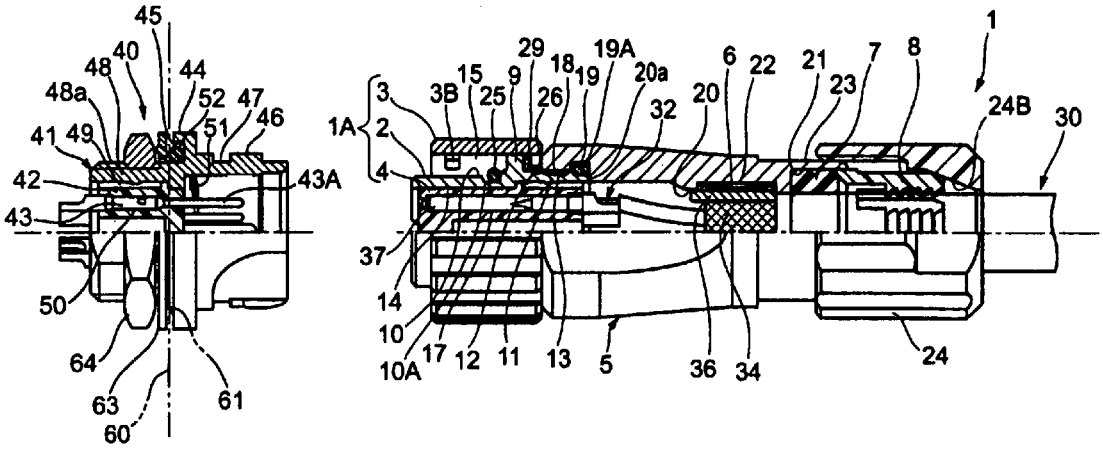
FIG. 1 is a partially sectional exploded view of a multiphase connector according to the present invention.

As shown in FIG. 1, the multiphase connector of the present invention includes a connector plug 1 as a connector and a receptacle 40 as a mating connector. The connector plug 1 includes a connector main body 1A. The connector main body 1A is formed of a plug shell 2 or a connector shell formed of metal; a sleeve 3 rotatably attached to the plug shell 2 to form a connector engaging portion 15 together with the plug shell 2; and an insulating case 4 formed of a synthetic resin disposed in the plug shell 2.

Figure 2:
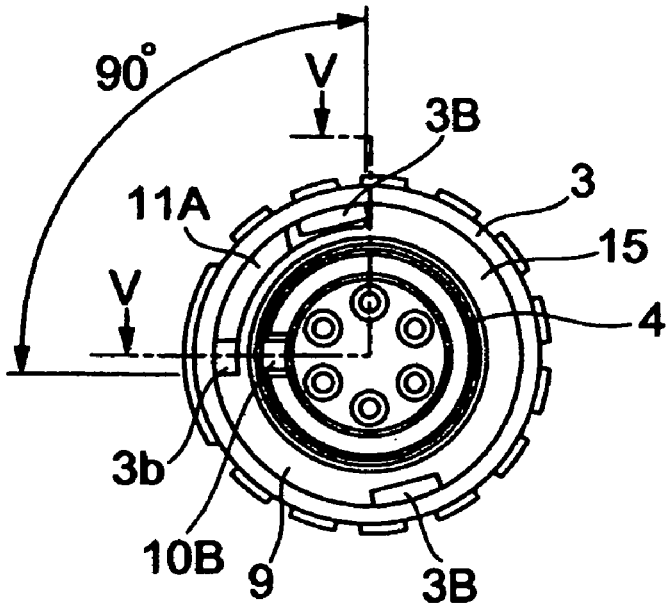
FIG. 2 is a front view of a plug connector of the multiphase connector.
Figure 3:
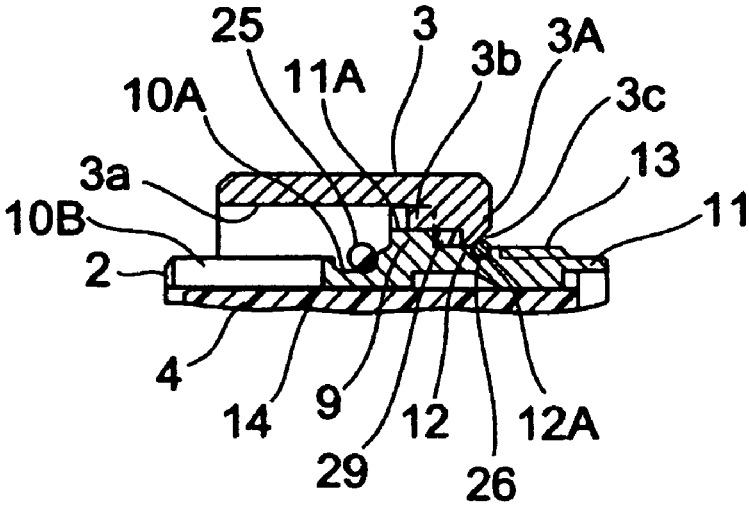
FIG. 3 is a sectional view taken along line V—V in FIG. 2.

The plug shell 2 is provided with a partition portion 9 at the middle of an outer circumferential surface thereof. A front portion from the partition portion 9 (left side in FIG. 1) becomes an engaging surface 10, and a rear portion from the partition portion 9 (right side in FIG. 1) becomes a cord tube connecting portion 11. As shown in FIG. 2, the partition portion 9 is provided with a sleeve rotation groove portion 11A over a range of substantially 90 degrees. The engaging surface portion 10 is provided with an engaging positioning groove portion 10B extending from a distal end portion to the partition portion 9 along a direction that the connector is inserted and pulled out. As shown in FIG. 3, the cord tube connecting portion 11 is provided with a sleeve supporting portion 12; a stopper ring insertion groove portion 12A; and a male screw portion 13. An insulating case insertion portion 14 is formed inside the plug shell 2.

The sleeve 3 is provided with a supporting portion 3A with a flange shape at a rear end portion thereof. As shown in FIG. 3, the supporting portion 3A is provided with a projecting portion 3*b* projecting in the direction that the connector is inserted and pulled out. An outer circumferential edge portion of the supporting portion 3A is chamfered, and the chamfered portion becomes a ring sliding portion 3*c*. As shown in FIG. 2, a pair of locking portions 3B with an engaging projecting shape is disposed on an inner circumferential surface 3*a* of the sleeve 3 at positions shifted by 180 degrees.

A waterproof O-ring 25 is disposed in an O-ring insertion groove portion 10A of the plug shell 2. A stopper ring 26 or a stopper is disposed in a stopper ring insertion groove portion 12A. The sleeve 3 is rotatably attached to the plug shell 2 with the supporting portion 3A supported on the sleeve supporting portion 12. A circumferential surface of the partition portion 9 contacts with and slides on an inner circumferential surface of the sleeve 3.

The projecting portion 3*b* of the sleeve 3 is inserted into the cord tube connecting portion 11A, and the ring sliding portion 3*c* of the sleeve 3 contacts and slides on the stopper ring 26. A spring washer 29 or a spring member is disposed between the supporting portion 3A of the sleeve 3 and the partition portion 9.

As described above, the sleeve 3 is rotatably attached to an outer circumferential surface of the plug shell 2 with the supporting portion 3A to be movable in the direction that the connector is inserted and pulled out, so that the partition portion 9 contacts with and slides on the inner circumferential surface 3*a* of the sleeve 3. The stopper ring 26 is disposed in the stopper ring insertion groove portion 12A of the plug shell 2. The spring washer 29 is disposed between the supporting portion 3A and the partition portion 9. With an urging force of the spring washer 29, the ring sliding portion 3*c* of the sleeve 3 contacts and slides on the stopper ring 26, thereby forming locking fixing means.

As described above, the projecting portion 3*b* of the sleeve 3 is inserted into the cord tube connecting portion 11A of the partition portion 9, thereby forming sleeve rotation restriction means. The insulating case 4 is inserted into the insulating case insertion portion 14 of the plug shell 2. The insulating case 4 is provided with a plurality of terminal insertion portions 17 along an axial direction thereof.

A female screw portion 18 of a cord tube 5 is screwed in the male screw portion 13, so that the cord tube 5 is connected to the cord tube connecting portion 11 of the plug shell 2. In this case, a waterproof O-ring 19A attached to an O-ring attaching groove portion 19 disposed in the cord tube 5 contacts and slides on an outer circumferential surface at an end portion of the cord tube connecting portion 11. A butting surface 20*a* of the cord tube 5 contacts and slides on an end surface of the cord tube connecting portion 11 of the plug shell 2. A shield wire cable 30 passes through an inner opening portion 20 of the cord tube 5. A female terminal 37 is connected to an exposed portion of a conductive body 32 at an end portion of the shield wire cable 30, and is inserted into and fixed to one of the terminal insertion portions 17 of the insulating case 4.

When a gasket 7 is inserted into a gasket attaching portion 21 of the cord tube 5, and a tightening ring 24 is screwed into a male screw portion 23 of the cord tube 5, a taper portion 24B disposed on an inner surface of the tightening ring 24 pushes a cord cramp 8, so that the cord cramp 8 moves toward the gasket 17 to push the gasket 7 with a distal end portion thereof. In this case, the gasket 7 is deformed in a radial direction to push the shield wire cable 30 for waterproof, and the cord cramp 8 is deformed in a radial direction to hold the shield wire cable 30.

A contact spring member 6 is attached to a spring member attaching portion 22 of the cord tube 5 in a state compressed in a radial direction. The contact spring member 6 contacts with an outer circumferential surface of an earth metal member 36 of the shield wire cable 30. In the connector plug 1 with the configuration described above, a shield layer 34 of the shield wire cable 30 is electrically connected to the plug shell 2 through the earth metal member 36, the contact spring member 6, and the cord tube 5.

Figure 4:
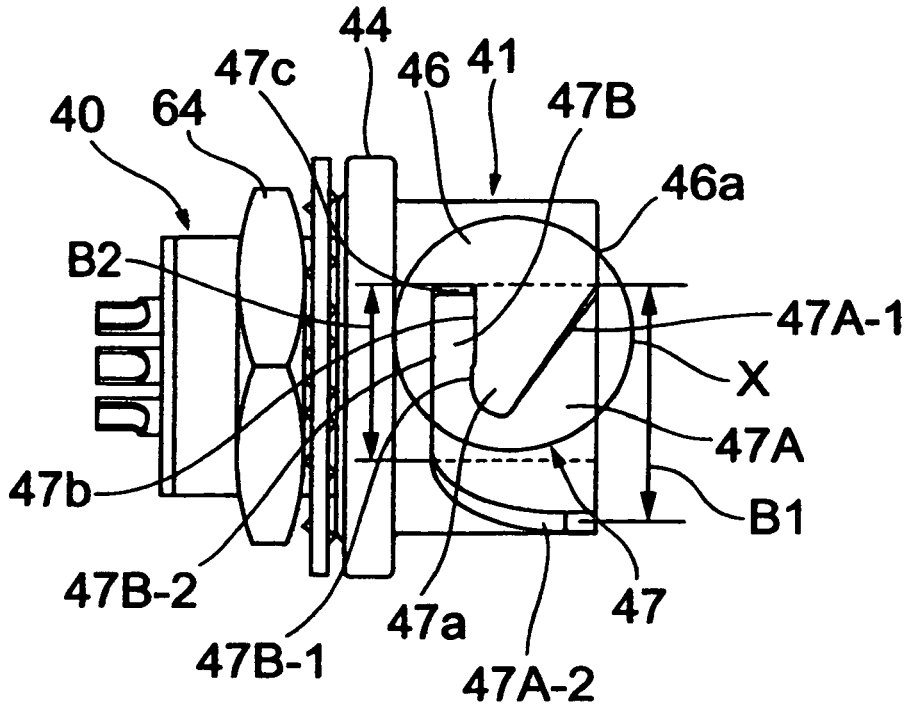
FIG. 4 is a side view showing a receptacle connector of the multiphase connector.
Figure 5:
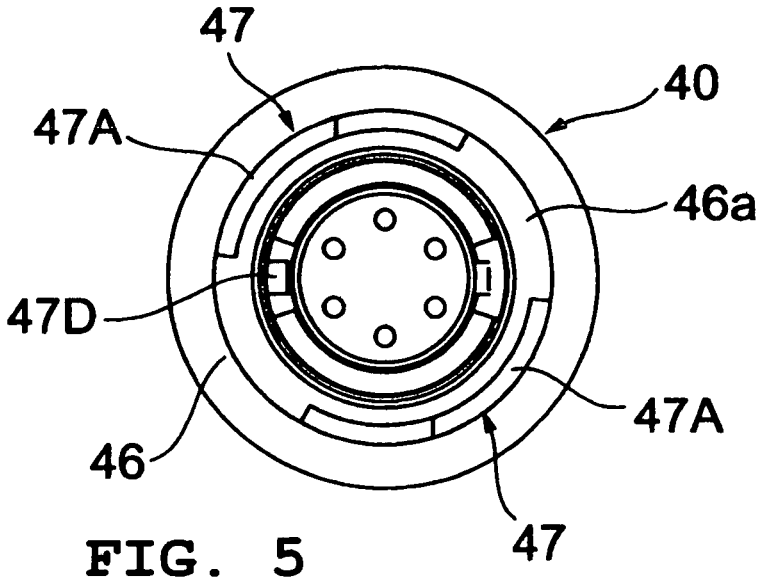
FIG. 5 is a front view of the receptacle connector.
Figure 6:
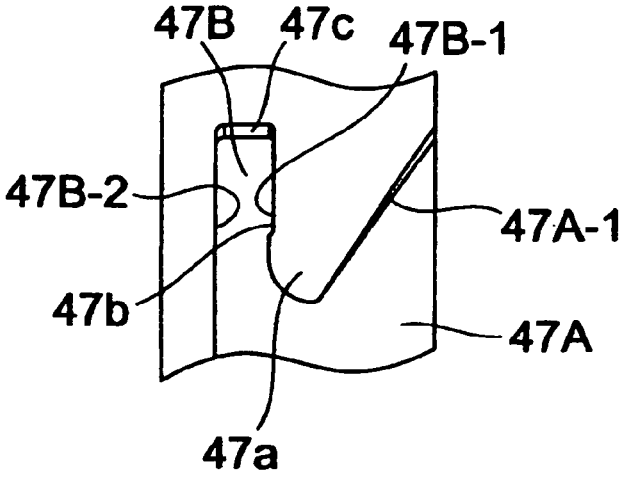
FIG. 6 is an enlarged view of a part X in FIG. 4.

As shown in FIG. 1 and FIG. 4, the receptacle 40 includes a receptacle shell 41 made of metal; an insulating case 42 made of a synthetic resin and inserted into the receptacle shell 41; and a plurality of male terminals 43 or contact terminals held with the insulating case 42. The receptacle shell 41 is provided with a flange portion 44 at a middle portion of an outer circumferential portion thereof. A front portion from the flange portion 44 (right side in FIG. 1) becomes a connector engaging portion 46 or a mating connector engaging portion with a cylindrical shape. As shown in FIG. 5, the connector engaging portion 46 is provided with locking groove portion 47 on the outer circumferential portion of the connector engaging portion 46 at positions shifted by 180 degrees. Each of the locking groove portions 47 is provided with a guide groove portion 47A and an engaging groove portion 47B connected to the guide groove portion 47A. As shown in FIG. 4, an entrance of the guide groove portion 47A has a width B1 larger than a width B2 of the engaging groove portion 47B.

The guide groove portion 47A has a funnel shape with a width gradually decreasing from a distal end (front edge) of the mating connector engaging portion 46 toward the flange portion 44. Inclined cam surfaces 47A-1 and 47A-2 inclined in opposite directions are formed on both side portions of the guide groove portion 47A. The engaging groove portion 47B is inclined in a direction perpendicular to the direction that the connector is inserted and pulled out. One of side surface portions 47B-1 of the engaging groove portion 47B is connected to one of the inclined cam surfaces 47A-1 of the guide groove portion 47A, and the other of the side surface portions 47B-2 of the engaging groove portion 47B is connected to the other of the inclined cam surfaces 47A-2 of the guide groove portion 47A.

A cam portion 47*a* is disposed on the one of the side surface portions 47B-1 of the engaging groove portion 47B as a bulge portion. A locking seat portion 47*b* is disposed between the cam portion 47*a* and an end surface portion 47*c* of the engaging groove portion 47B. As shown in FIG. 5, an engaging positioning projecting portion 47D is formed on an inner circumferential surface of the connector engaging portion 46 along the direction that the connector is inserted and pulled out. A male screw portion 48A is formed on a cylindrical portion 48 at a rear side (left side in FIG. 1) of the flange portion 44. An insulating case insertion portion 49 is formed inside the receptacle shell 41.

The insulating case 42 is inserted into the insulating case insertion portion 49. The male terminals 43 are fitted in terminal insertion portions 50 of the insulating case 42. Contact portions 43A of the male terminals 43 are inserted into the connector engaging portion 46. A contact member 51 with a ring shape is inserted into the connector engaging portion 46. The contact member 51 has a shape waving in a circumferential direction, and a backside surface of the contact member 51 contacts with the receptacle shell 41. Locking means is formed of the locking portions 3B disposed on the sleeve 3 of the connector plug 1; the locking groove portions 47 disposed on the connector engaging portion 46 of the receptacle 40; and the locking fixing means.

A process of connecting and releasing the connection between the connector plug 1 and the receptacle 40 thus configured will be explained next.

As shown in FIG. 1, the screw portion 48 of the receptacle shell 41 is inserted into, for example, an attaching hole 61 in a wall portion 60 of a conductive housing (not shown) of an electrical device. Then, a washer 63 is placed on the screw portion 48 and a tightening nut 64 is screwed and tightened in the screw portion 48, so that the flange portion 44 and the washer 63 sandwich the wall portion of the housing, thereby attaching the receptacle 40 to the housing. In this case, the waterproof O-ring 52 attached to the O-ring attaching portion 45 on the flange portion 44 abuts against the wall portion 66.

With the engaging positioning groove portion 10B and the engaging positioning projecting portion 47D, the connector plug 1 and the receptacle 40 engage and are positioned. Then, the connector engaging portion 46 of the receptacle shell 41 is fitted in the connector engaging portion 15 of the connector plug 1, so that connecting portions of the female terminals 37 are connected to the contact portions 43A of the male terminals 43, and a distal end portion 2A of the plug shell 2 contacts with the receptacle shell 41 through the contact member 51.

In the locking means described above, when the connector engaging portion 46 of the receptacle shell 41 is fitted in the connector engaging portion 15 of the connector plug 1, the connector plug 1 and the receptacle 40 engage and are positioned with the engaging positioning groove portion 10B and the engaging positioning projecting portion 47D. The locking portion 3B of the sleeve 3 is inserted into the guide groove portion 47A of the locking groove portions 47 of the connector engaging portion 46, and the sleeve 3 is rotated, so that the locking portion 3B detachably engages the engaging groove portion 47B.

Figure 7:
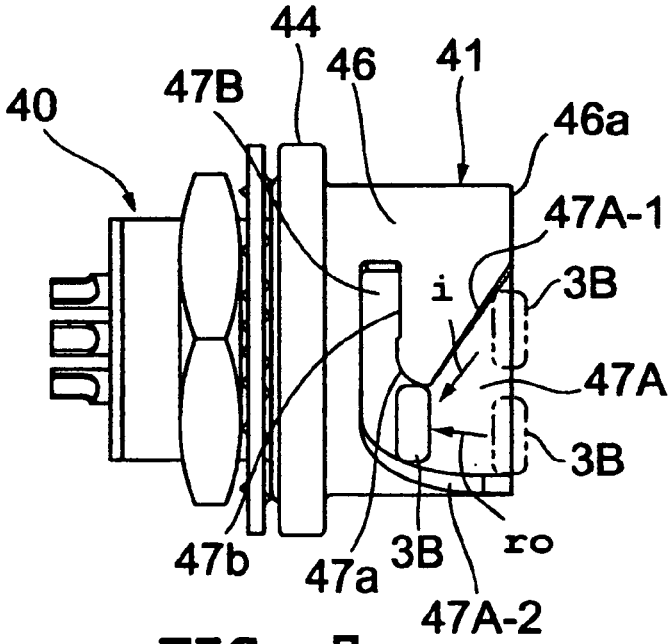
FIG. 7 is an explanatory view for explaining an insertion of a locking portion into a locking groove portion.
Figure 8:
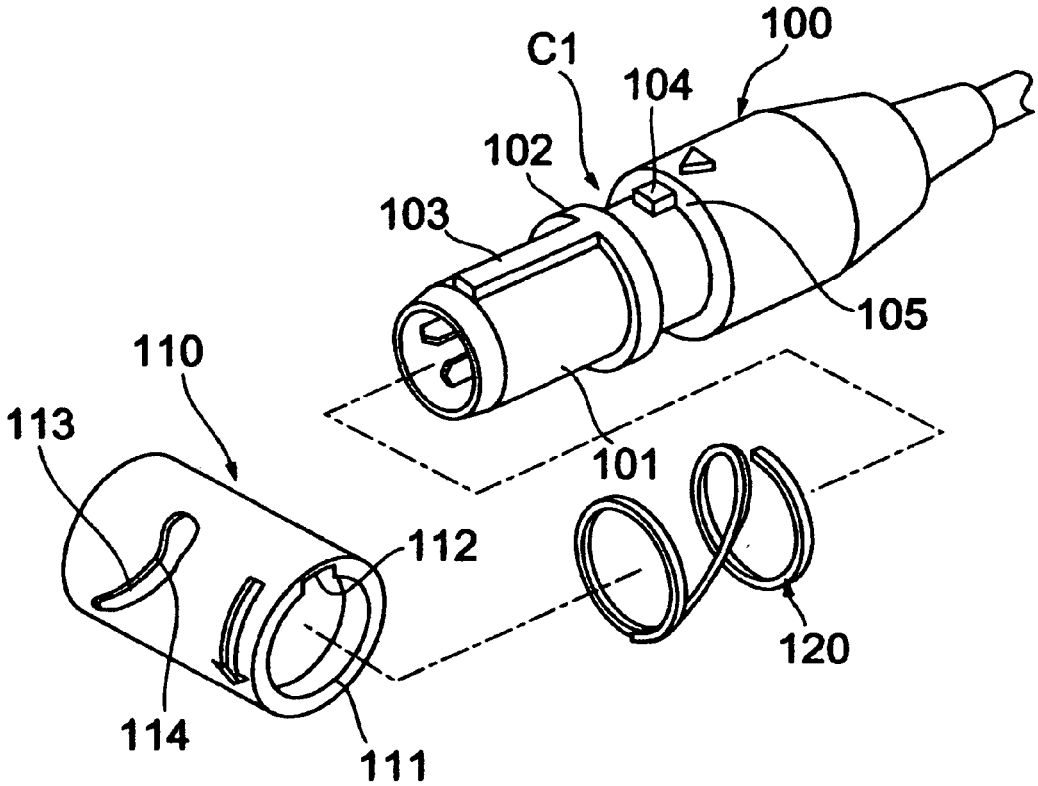
FIG. 8 is an exploded perspective view showing a conventional multiphase connector.
Figure 9:
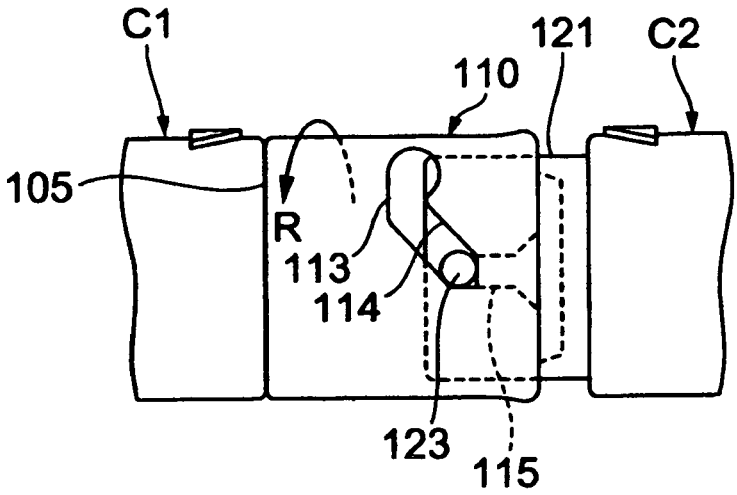
FIG. 9 is a side view of a state that a connector is connected to a mating connector.
Figure 10:
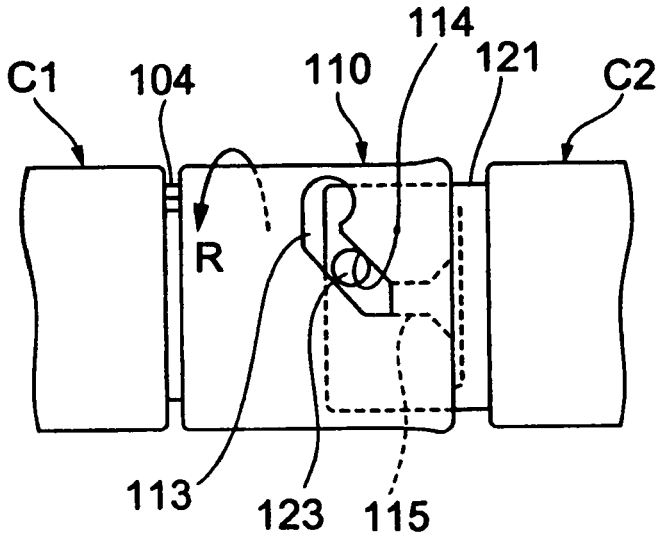
FIG. 10 is a schematic side view showing an initial stage of a locking operation.
Figure 11:
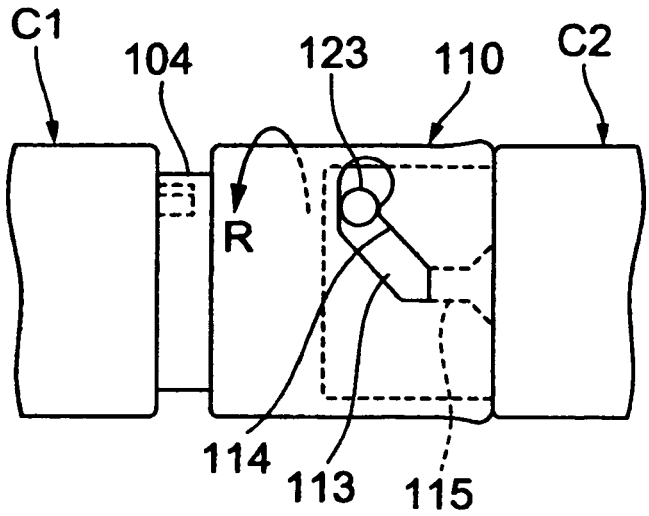
FIG. 11 is a schematic side view showing a middle stage of the locking operation.
Figure 12:
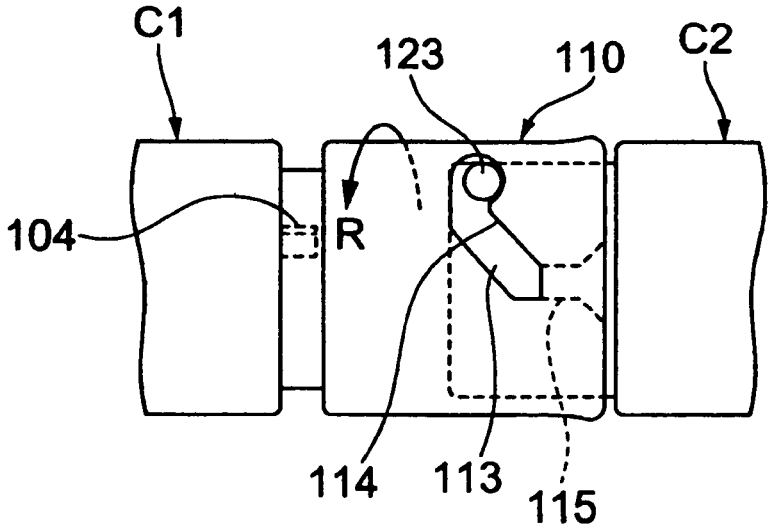
FIG. 12 is a schematic side view showing a locked state
Figure 13:
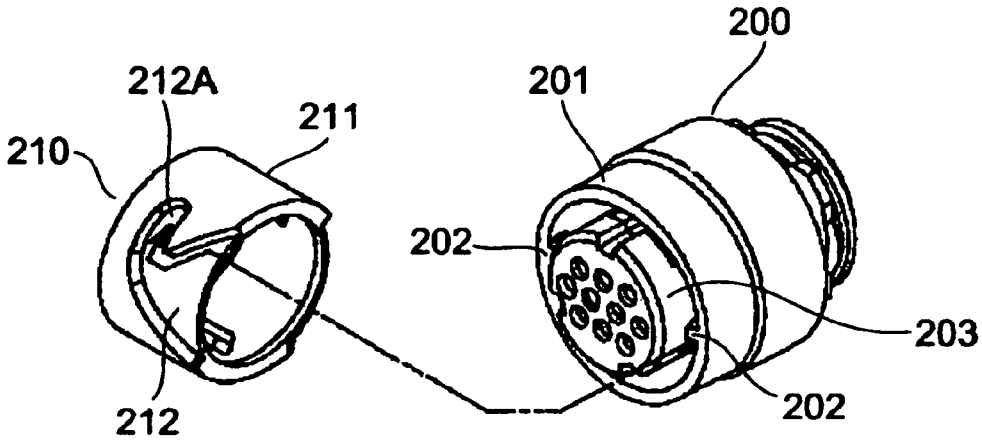
FIG. 13 is an exploded perspective view showing another conventional multiphase connector.
Figure 14:
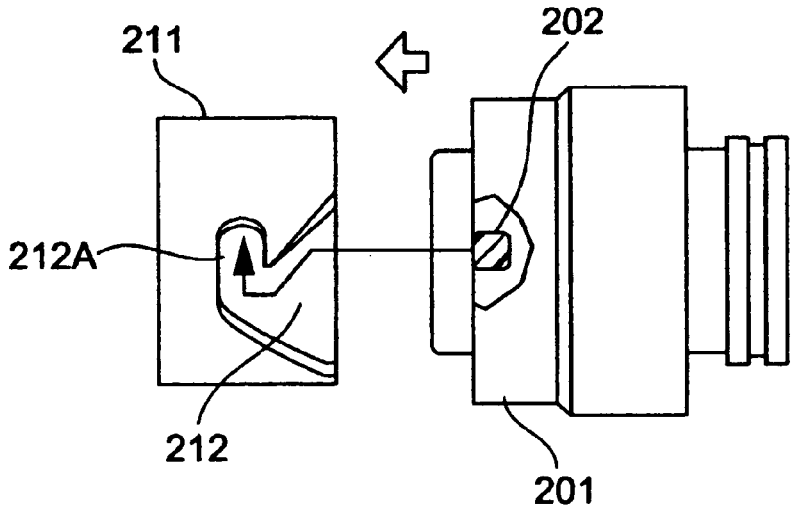
FIG. 14 is a schematic side view showing an initial stage of a locking operation of the multiphase connector.

As indicated by a Japanese character "i" arrow in FIG. 7, there is a case that the locking portion 3B slides on the inclined cam surface 47A-1 and inserted into the engaging groove portion 47B to reach the locking seat portion 47*b*. Also, as indicated by a Japanese character "ro" arrow in FIG. 7, there is a case that the locking portion 3B slides on the other inclined cam surface 47A-2 and inserted into the engaging groove portion 47B to reach the locking seat portion 47*b*. In both cases, when the locking portion 3B reaches the locking seat portion 47*b*, the spring washer 29 pushes the sleeve 3 in the right direction in FIG. 1 with an urging force (spring force) thereof, so that the locking portion 3B is seated on the locking seat portion 47*b*. In this case, even though the sleeve 3 tries to rotate in an opposite direction, the cam portion 47*a* interferes with the locking portion 3B, so that the sleeve 3 does not rotate in the opposite direction.

As described above, in the state that the connector engaging portion 46 completely engages the connector engaging portion 15, the distal end portion 2A of the plug shell 2 contacts with the receptacle shell 41 through the contact member 51. Accordingly, the shield layer 34 of the shield wire cable 30 is electrically connected to the wall portion 60 of the housing of the electrical device through the earth metal member 36, the contact spring member 6, the cord tube 5, the plug shell 2, the contact member 51, and the receptacle shell 41. When the engagement between the connector plug 1 and the receptacle 40 is released, the sleeve 3 is rotated in reverse. Accordingly, the locking portion 3B moves out of the engaging groove portion 47B over the cam portion 47*a* to slide and contact with the inclined cam surface 47A-2 of the guide groove portion 47A, so that the connector plug 1 can be pulled out from the receptacle 40.

As explained above, in the embodiments of the present invention, the locking portion 3B of the sleeve 3 is inserted into the guide groove portion 47A of the locking groove portions 47 of the connector engaging portion 46, and the sleeve 3 is rotated. When the locking portion 3B slides on the cam portion 47*a* and reaches the locking seat portion 47*b*, the spring washer 29 pushes the locking portion 3B through the sleeve 3 to be seated on the locking seat portion 47*b*, thereby completing the locking. When the engagement is released, the sleeve 3 is rotated in reverse, so that the locking portion 3B moves out the locking seat portion 47*b* through the cam portion 47*a* to the guide groove portion 47A.

Accordingly, as compared with the conventional connector, it is not necessary to restrict the rotational angle of the sleeve (positioning) at an initial position. Therefore, it is not necessary to move the sleeve forward for releasing the rotational restriction of the sleeve, thereby making it possible to reduce a whole size of the connector. Further, it is not necessary to arrange a torsion coil spring for inserting each engaging pin into a lock portion of each cam groove to lock, thereby eliminating a step of fixing the torsion coil spring and making it easy to assemble.

In the embodiments of the present invention, the sleeve 3 is rotatably attached to the outer circumference surface of the plug shell 2 with the supporting portion 3A to be movable in the direction that the connector is inserted and pulled out. The partition portion 9 slides and contacts with the inner circumference surface of the sleeve 3. The stopper ring 26 is provided on the stopper ring insertion groove portion 12A of the plug shell 2. The spring washer 29 is disposed between the supporting portion 3A and the partition portion 9 for urging the supporting portion 3A to slide and contact with the stopper ring 26, thereby forming the locking fixing means. Accordingly, in the locking fixing portion, the spring washer 29 is compressed when the locking portion 3B moves on the cam portion 47*a*. When the locking portion 3B is seated on the locking seat portion 47*b*, the spring washer 29 presses the locking portion 3B against the locking seat portion 47*b*, thereby securely seating the locking portion 3B on the locking seat portion 47*b*. Accordingly, the cam portion 47*a* interferes with the locking portion 3B not to move, thereby securing the locking. Further, the sleeve 3 does not come off the plug shell 2 with the stopper ring 26. Accordingly, when the plug connector 1 is disassembled, the sleeve 3 does not come off, thereby making it easy to disassemble and assemble.

In the embodiments of the present invention, the sleeve rotation groove portion 11A is formed in the partition portion 9 over a specific angle range. The projecting portion 3*b* is disposed on the supporting portion 3A. The projecting portion 3*b* is inserted into the sleeve rotation groove portion 11A to set a rotational range of the sleeve 3. Accordingly, it is possible to set the rotational range of the sleeve 3 according to a position of the locking groove portion 47.

In the embodiments of the present invention, the guide groove portion 47A has a funnel shape with a width gradually decreasing from the distal end of the connector engaging portion 46 in the direction that the connector is inserted and pulled out. The inclined cam surfaces 47A-1 and 47A-2 inclined in opposite directions are formed on both side portions of the guide groove portion 47A. The engaging groove portion 47B is inclined in a direction perpendicular to the direction that the connector is inserted and pulled out. One of the side surface portions 47B-1 is connected to one of the inclined cam surfaces 47A-1, and the other of the side surface portions 47B-2 is connected to the other of the inclined cam surfaces 47A-2. The bulge portion is disposed on the one of the side surface portions 47B-1 as the cam portion 47*a*. The cam portion 47*a* positions the locking seat portion 47*b* at the end portion of the engaging groove portion 47B. Accordingly, when the connector plug 1 is fitted in the receptacle 40, the locking portion 3B slides against one or the other of the inclined cam surfaces 47A-1 and 47A-2 to the position in FIG. 7 to rotate the sleeve 3. As a result, the locking portion 3B is inserted into the engaging groove portion 47B, and reaches the locking seat portion 47*b* through moving over the cam portion 47*a*. The spring washer 29 urges the locking portion 3B to be seated on the locking seat portion 47*b*. In this state, the cam portion 47*a* interferes with the locking portion 3B not to move, thereby securing the locking.

According to the multiphase connector of the present invention, it is possible to reduce a whole size of the connector. It is easy to assemble the connector. The sleeve does not come off the connector shell with the stopper. Accordingly, when the connector is disassembled, the sleeve does not come off, thereby making it easy to disassemble and assemble. Therefore, the multiphase connector of the present invention is useful as an electrical connector.

The invention claimed is:

1. A multiphase connector, comprising:

a connector engaging portion of a connector engaging a mating connector engaging portion of a mating connector so that a contact terminal of the multiphase connector contacts with a contact terminal of the mating connector, and lock means connecting the connector to the mating connector; wherein said connector engaging portion includes a connector main body and a sleeve attached to the connector main body to be rotatable within a specific angle;

said lock means includes a locking portion disposed on the sleeve and a locking groove portion disposed on the mating connector engaging portion;

said locking groove portion includes a guide groove portion guiding the locking portion when the sleeve is rotated, and an engaging groove portion detachably engaging the locking portion when the sleeve is further rotated;

an entrance portion of the guide groove portion has a width larger than that of the engaging groove portion; and sleeve rotation restricting means restricts a rotational amount of the sleeve upon engaging between the guide groove portion and the engaging groove portion.

2. The multiphase connector according to claim 1, wherein said sleeve is movable within a specific amount in a direction that the connector is inserted and pulled out; said locking means includes locking fixing means; said engaging groove portion includes a cam portion and a locking seat portion; said locking fixing means includes a spring member to be compressed when the locking portion slides against the cam portion upon rotating the sleeve; and said spring member urges the locking portion to be seated on the locking seat portion.

3. The multiphase connector according to claim 1, wherein said connector includes a connector shell; said connector shell is provided with a partition portion on an outer circumferential surface thereof; said sleeve includes a supporting portion at an end portion thereof; said sleeve is attached to the outer circumferential surface of the connector shell with the supporting portion to be rotatable and movable in a direction that the connector is inserted and pulled out so that the partition portion slides on an inner circumferential surface of the sleeve; a stopper is provided on the outer circumferential surface of the connector shell; and said spring member is disposed between the supporting portion and the partition portion and urges the supporting portion to slide against the stopper, thereby forming the locking fixing means.

4. The multiphase connector according to claim 3, wherein said sleeve rotation restricting means includes a sleeve rotation groove portion in the partition portion over a specific angle range; a projecting portion is disposed on the supporting portion; and said projecting portion is inserted into the sleeve rotation groove portion to regulate a rotational range of the sleeve.

5. The multiphase connector according to claim 2, wherein said guide groove portion has a funnel shape with a width gradually decreasing from a distal end of the mating connector engaging portion in the direction that the connector is inserted and pulled out; inclined cam surfaces inclined in opposite directions are formed on both side portions of the guide groove portion; said engaging groove portion is inclined in a direction perpendicular to the direction that the connector is inserted and pulled out; one of side surface portions of the engaging groove portion is connected to one of the inclined cam surfaces; the other of the side surface portions is connected to the other of the inclined cam surfaces; a bulge portion is disposed on the one of the side surface portions as the cam portion; and said cam portion positions the locking seat portion at an end portion of the engaging groove portion.

6. The multiphase connector according to claim 2, wherein said connector includes a connector shell; said connector shell is provided with a partition portion on an outer circumferential surface thereof; said sleeve includes a supporting portion at an end portion thereof; said sleeve is attached to the outer circumferential surface of the connector shell with the supporting portion to be rotatable and movable in a direction that the connector is inserted and pulled out so that the partition portion slides on an inner circumferential surface of the sleeve; a stopper is provided on the outer circumferential surface of the connector shell; and said spring member is disposed between the supporting portion and the partition portion and urges the supporting portion to slide against the stopper, thereby forming the locking fixing means.

7. The multiphase connector according to claim 3, wherein said guide groove portion has a funnel shape with a width gradually decreasing from a distal end of the mating connector engaging portion in the direction that the connector is inserted and pulled out; inclined cam surfaces inclined in opposite directions are formed on both side portions of the guide groove portion; said engaging groove portion is inclined in a direction perpendicular to the direction that the connector is inserted and pulled out; one of side surface portions of the engaging groove portion is connected to one of the inclined cam surfaces; the other of the side surface portions is connected to the other of the inclined cam surfaces; a bulge portion is disposed on the one of the side surface portions as the cam portion; and said cam portion positions the locking seat portion at an end portion of the engaging groove portion.

8. The multiphase connector according to claim 4, wherein said guide groove portion has a funnel shape with a width gradually decreasing from a distal end of the mating connector engaging portion in the direction that the connector is inserted and pulled out; inclined cam surfaces inclined in opposite directions are formed on both side portions of the guide groove portion; said engaging groove portion is inclined in a direction perpendicular to the direction that the connector is inserted and pulled out; one of side surface portions of the engaging groove portion is connected to one of the inclined cam surfaces; the other of the side surface portions is connected to the other of the inclined cam surfaces; a bulge portion is disposed on the one of the side surface portions as the cam portion; and said cam portion positions the locking seat portion at an end portion of the engaging groove portion.

* * * * *